US010064469B2

(12) United States Patent
Quessard et al.

(10) Patent No.: US 10,064,469 B2
(45) Date of Patent: Sep. 4, 2018

(54) COMPACT HAIR DRYER AND REMOVABLE BARREL EXTENSION

(75) Inventors: Roland Quessard, Romorantin-Ianthenay (FR); Michel Guillosson, Olivet (FR)

(73) Assignee: VELECTA PARAMOUNT, Paris (FR)

( * ) Notice: Subject to any disclaimer, the term of this patent is extended or adjusted under 35 U.S.C. 154(b) by 675 days.

(21) Appl. No.: 13/882,880

(22) PCT Filed: Nov. 4, 2011

(86) PCT No.: PCT/FR2011/052582

§ 371 (c)(1),
(2), (4) Date: May 1, 2013

(87) PCT Pub. No.: WO2012/059700

PCT Pub. Date: May 10, 2012

(65) Prior Publication Data

US 2013/0239427 A1 Sep. 19, 2013

(30) Foreign Application Priority Data

Nov. 5, 2010 (FR) ..... 10 59179

(51) Int. Cl.
*A45D 20/00* (2006.01)
*A45D 20/10* (2006.01)
*A45D 20/12* (2006.01)

(52) U.S. Cl.
CPC ..... *A45D 20/00* (2013.01); *A45D 20/10* (2013.01); *A45D 20/12* (2013.01)

(58) Field of Classification Search
CPC ..... A45D 20/00; A45D 20/10; A45D 20/12
See application file for complete search history.

(56) References Cited

U.S. PATENT DOCUMENTS 4,848,007 A * 7/1989 Montagnino ..... A45D 20/122 239/419.5
7,412,781 B2 8/2008 Mattinger
7,676,952 B2 * 3/2010 Nakagawa ..... A45D 20/12 239/690

(Continued)

FOREIGN PATENT DOCUMENTS

EP 0064405 A1 * 11/1982 ..... A45D 6/06
EP 1415566 A2 5/2004

(Continued)

*Primary Examiner* — Jessica Yuen
(74) *Attorney, Agent, or Firm* — Hauptman Ham, LLP

(57) ABSTRACT

A compact hair dryer comprising a main body having a front and a rear portion. The front portion comprising a first duct surrounding a second duct, air flow passing through the second duct being heated by a heating means, air flow passing through the space between the first and second ducts being insulated from the heated air flow in the second duct. The second duct is shaped like a truncated cone of revolution, wherein a distribution means is arranged at the base of the cone to determine the amount of air flow passing through the space between the first and second ducts. A barrel extension comprising at least one peripheral tube surrounding a central tube connectable to the outlet of the hair dryer. The second duct of the hair dryer, at the air outlet of the hair dryer, arranged to be connectable to the central tube of a barrel extension.

16 Claims, 3 Drawing Sheets

(56) References Cited

U.S. PATENT DOCUMENTS

| | | | | |
|---|---|---|---|---|
| 2004/0083620 | A1 | 5/2004 | McCambridge et al. | |
| 2009/0188126 | A1 * | 7/2009 | Gaillard ..... | A45D 20/12 34/97 |

FOREIGN PATENT DOCUMENTS

| | | | | | |
|---|---|---|---|---|---|
| JP | 2010274050 | A * | 12/2010 | | |
| WO | WO 0001270 | A1 * | 1/2000 | ..... | A45D 20/12 |

* cited by examiner

View according to section a-a'

COMPACT HAIR DRYER AND REMOVABLE BARREL EXTENSION

The present invention relates to the field of hairdressing. The present invention more particularly proposes a compact and ergonomic hair dryer.

A hair dryer usually includes a main body and a handle attached to the main body. A flow of fresh air is sucked up through an air intake laid out in the rear portion of the main body so as to be heated up by a heating system and be channeled towards the front portion of the main body generally having a general axisymmetrical shape and including an air outlet. The air outlet is generally provided at its end with an endpiece. Certain hair dryers are said to be compact hair dryers which have reduced dimensions so as to make them more easy to use, such as for example with a length of the order of the total width of two hands side by side and/or a front portion with a length of the order of the width of one hand with a rear portion generally with a further more restricted length. This more ergonomic configuration has several advantages. First, it allows the use of less material and therefore has the possibility of being more lightweight than non-compact hair dryers. Further, as the distance between the handle and the air outlet is small, its use is less difficult and more accurate since the distance between the hand which holds the hairdryer with the handle and the hair may be shorter. For example, the user of the hairdryer will not have to excessively extend the arm in order to use it for drying his/her hair. Further, the hairdressing professional will be more accurate since he/she has the possibility of being able to hold the hair dryer with the handle close to the hair of the person whose hair has to be done. Moreover, many hairdressers for practical reasons have the habit of holding the hair dryer with the front portion of the hair dryer between the handle and the air outlet, often for reducing musculoskeletal disorders and the difficulty of holding the hair dryer for hours and/or for allowing more accuracy. Now, the distance between the air outlet and the handle for a compact hair dryer is generally smaller than the width of the hand of the hairdresser, a portion of which may then be found on the path of the air flow flowing out of the hair dryer. The air of a hair dryer may be very hot, the portion of the hand on the path of the outgoing air flow risks being burnt. Even if the hand is not on the path of the outgoing airflow, if the user holds the hair dryer with the front portion, the shell of the hair dryer is generally too hot at this location for being held with a bare hand.

The object of the present invention is therefore to overcome one or several of the drawbacks of the prior art by proposing a compact hair dryer allowing it to be grasped with its front portion without any risk of burns.

For this purpose, the invention relates to a compact hair dryer, characterized in that it includes at least one main body having a front portion and a rear portion and containing a motor driving a device producing an air flow, sucked up through an air intake laid out in the rear portion, the air flow being channeled in the front portion of the main body towards an air outlet laid out in the front portion, the front portion including a first duct surrounding a second duct, the ducts being crossed by the air flow, the portion of the air flow passing through the second duct being heated up by a heating means, the air outlet of the hair dryer being extended with an extension including at least one graspable peripheral tube surrounding a central tube, each tube including an inlet end and a free end, at least the inlet end of the central tube being laid out according to a shape mating the end of the second duct of the hair dryer so as to be able to be connected to the second duct of the hair dryer.

According to another particularity, the second duct has the shape of a truncated cone of revolution, a plurality of longitudinal slots being distributed at the base of the cone in order to allow the passing of a portion of the air flow.

According to another particularity, the extension has a length greater than or equal to the width of two or three fingers and less than or equal to the width of four or five fingers.

According to another particularity, the extension is removable.

According to another particularity, the plurality of longitudinal slots distributed at the base of the cone are for determining the ratio of the amount of air between the heated air passing through the second duct and the non-heated air passing through the space between the first and the second duct so that the amount of air flow crossing through the space between the first and the second duct is comprised in a range from 5% to 20%.

The invention also relates to an extension for extending the air outlet of a hair dryer, the hair dryer including at least one first duct surrounding a second duct, the extension being characterized in that it includes at least one graspable peripheral tube surrounding a central tube, each tube including an inlet end and a free end, at least the inlet end of the central tube being laid out according to a shape mating the end of the second duct of the hair dryer so as to be able to be connected to the second duct of the hair dryer blowing hot air, surrounded by the second duct blowing cold air.

According to another particularity, the connection between the central tube of the extension and the second duct of the hair dryer is a conical connection.

According to another particularity, the inlet end of the peripheral tube is laid out according to a shape mating the end of the first duct of the hair dryer so as to be able to be fitted into the first duct of the hair dryer.

According to another particularity, the peripheral tube is coaxial with the central tube.

According to another particularity, the free end of the peripheral tube of the extension extends beyond the free outlet end of the central tube in order to form an air concentrator or an air diffuser.

According to another particularity, the free end of the central tube of the extension extends beyond the outlet free end of the peripheral tube in order to form an air concentrator or an air diffuser.

According to another particularity, the extension is removable.

According to another particularity, the extension has a length greater than or equal to the width of two or three fingers and less than or equal to the width of four or five fingers.

The invention also relates to a hair dryer including at least one main body having a front portion and a rear portion and containing a motor driving a device producing an air flow, sucked up through an air intake laid out in the rear portion, the air flow being channeled into the front portion of the main body towards an air outlet laid out in the front portion, the hair dryer being characterized in that the front portion includes a first duct surrounding a second duct, the ducts being crossed by the air flow, the portion of the air flow passing through the second duct being heated up by a heating means.

According to another particularity, an extension extends the air outlet of the hair dryer, the extension including at least one graspable peripheral tube surrounding a central tube, each tube including an inlet end and a free end, at least the inlet end of the central tube being laid out according to a shape mating the end of the second duct of the hair dryer so as to be able to be connected to the second duct of the hair dryer.

The invention also relates to a compact hair dryer including at least one main body having a front portion and a rear portion and containing a motor driving device producing an air flow, sucked up through an air intake laid out in the rear portion, the air flow being channeled in the front portion of the main body towards an air outlet laid out in the front portion, the front portion including a first duct surrounding a second duct, a portion of the air flow brought by the device producing an air flow, passing through the second duct being heated up by a heating means, another portion of the air flow, brought by the device producing an air flow, passing through the space between the first and the second duct being isolated from the portion of the air flow heated in the second duct, the hair dryer being characterized in that the second duct includes at least one portion having the shape of a truncated cone of revolution, for channeling a portion of the flow towards the center and distribution means being laid out at the base of the cone in order to determine the proportion between the amount of air flow crossing the space between the first and second duct on the one hand and that passing into the second duct including the heating means on the other hand.

According to another particularity, the distribution means determine the portion between the amount of air flow crossing the space between the first and second duct on the one hand and that passing into the second conduit including the heating means on the other hand so that the amount of air flow crossing the space between the first and the second duct is comprised in a range from 5% to 20% of the air flow brought by the device producing an air flow.

According to another particularity, the distribution means are at least one longitudinal slot distributed at the base of the cone.

According to another particularity, the distribution means are at least one ring-shaped passage in proximity to the base of the cone, the center of each ring-shaped slot being comprised in the axis of the cone.

According to another particularity, the plurality of slots determine the proportion between the amount of air flow crossing the space between the first and the second duct on the one hand and that passing into the second duct including the heating means on the other hand so that the amount of air flow crossing the space between the first and the second duct is comprised in a range from 5% to 20% of the air flow brought by the device producing an air flow.

According to another particularity, the diameter of the circle at the base of the cone is adjusted to the inner diameter of the first duct.

According to another particularity, the distribution means are formed by the space laid out between the base of the cone and the inner surface of the first duct, the diameter of the circle at the base of the cone being less than the inner diameter of the first duct in the area closest to the base of the cone.

Other particularities and advantages of the present invention will become more clearly apparent upon reading the description hereafter, made with reference to the appended drawings:

FIG. 1 represents a schematic profile view of the hair dryer and of the extension detached from the hair dryer;

FIG. 1*a* illustrates a schematic profile view of the hair dryer and of the extension attached to the hair dryer;

Figure 1:
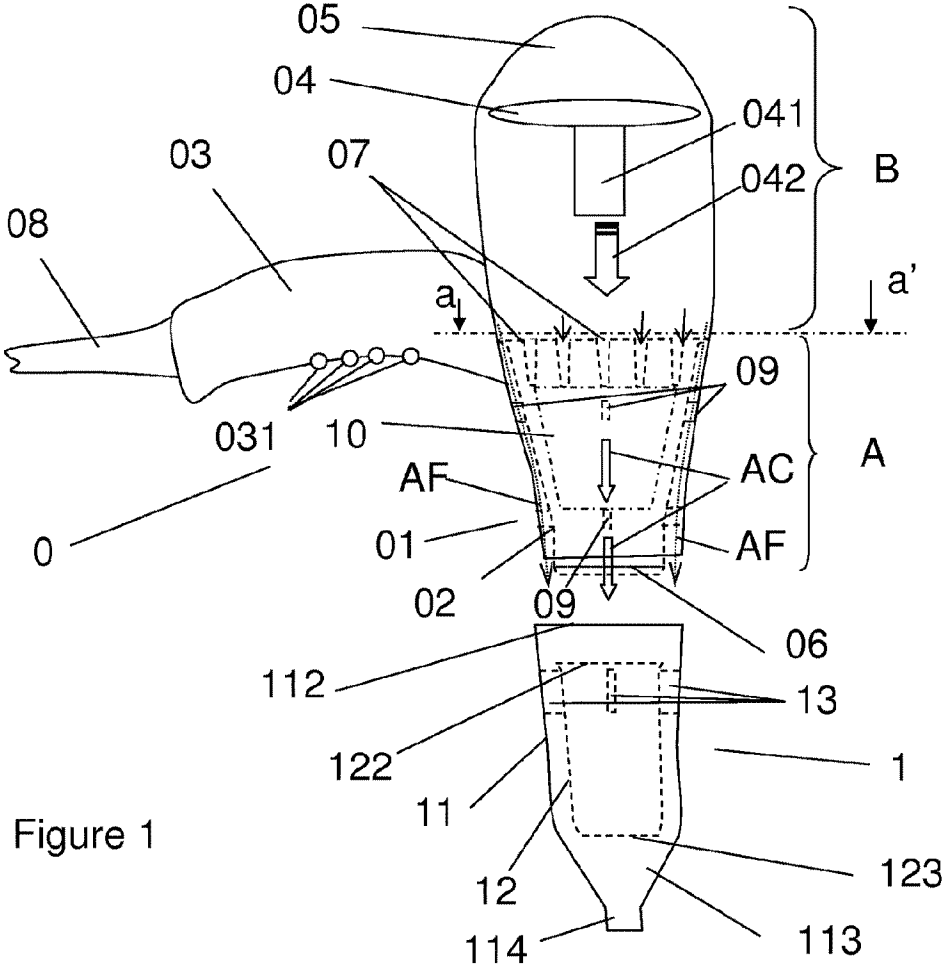
Figure 1A:
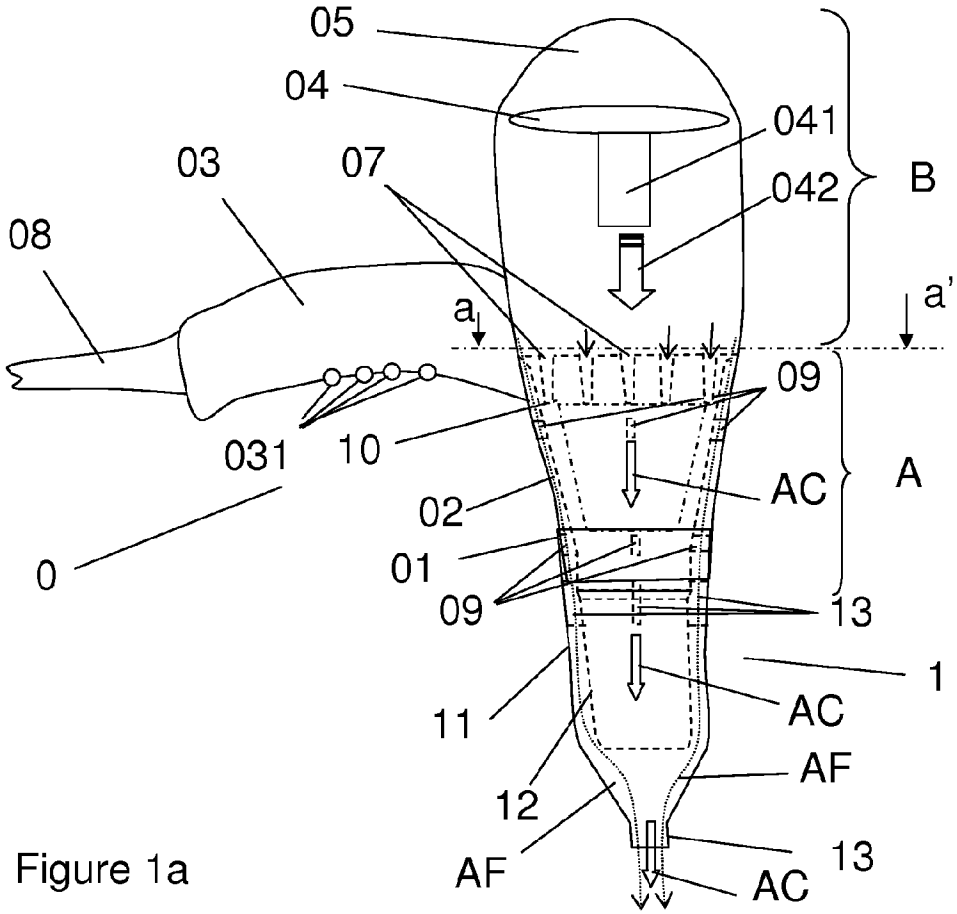
Figure 3:
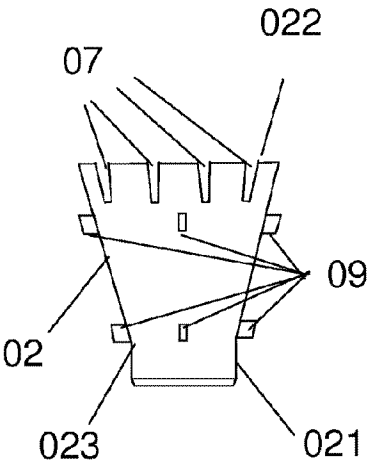
FIG. 3 illustrates a schematic profile view of the second duct.
Figure 3A:
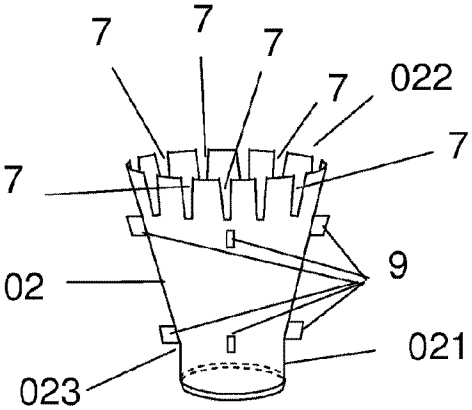
Figure 2:
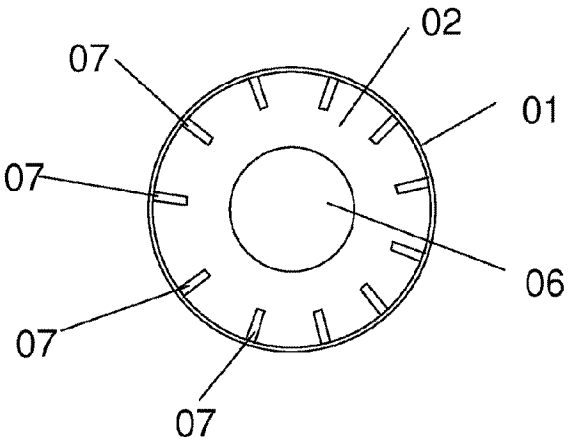
FIG. 2 illustrates a schematic view of the hair dryer along a section a-a'.

FIG. 3*a* illustrates a perspective view of the second duct.

The invention will be described with reference to FIGS. 1, 1*a*, 2, 3 and 3*a*.

The present invention proposes a solution for grasping with the bare hand without burning oneself the front portion of a notably compact hair dryer (0).

In certain embodiments, the hair dryer (0) includes at least one main body having a front portion (A) and a rear portion (B). The rear portion (B) contains for example a motor (041) driving a device (04) producing an air flow (042) sucked up first through an air intake (05) laid out in the rear portion (B). The air flow (042) is channeled in the front portion (A) of the main body towards an air outlet (06) laid out in the front portion (A). The hair dryer (0) further includes a heating means (10) giving the possibility of heating at least one portion of the air flow (042).

In certain embodiments, the hair dryer (0) further includes a grip handle (03) which in a non-limiting way has at least one button (031) for switching on/off the hair dryer (0). The grip handle (08) also includes for example a button (031) for controlling the speed of the device (04) for producing the air flow (042) and/or a button (031) for switching on/off a device for producing ions and/or a button for regulating the heat produced by the heating means (10).

In certain embodiments, the hair dryer is compact.

In certain of these embodiments, the distance between the handle and the air outlet is short.

In other embodiments, the hair dryer is laid out so that the center of gravity of the latter is located at or in proximity to the handle (03).

It is therefore understood that the notion of compactness is used here with reference to the ease in handling the hair dryer which avoids musculoskeletal disorders regardless of its being actually short or not. The invention moreover proposes an extension which extends the hair dryer without burdening in a too substantial way the front portion and which remains useable with the handle but especially making it graspable from the front.

In certain embodiments, the front portion (A) of the hair dryer (0) includes a first duct (01) surrounding a second duct (02), the main axes of which are parallel. The air flow (042) produced by the device driven by the motor (041) crosses the ducts and is distributed between the second duct (02) and the space between the first (01) and the second (02) duct. The portion (AC) of the air flow passing through the second duct (02) is heated by a heating means (10), for example a heating resistor, for example positioned in the second duct (02).

In certain embodiments, the temperature and the operation of the heating means (10) are controlled with one or several buttons located on the grip handle (03). The portion (AF) of the air flow crossing the space between the first (01) and the second (02) duct is isolated from the heated airflow (AC) in the second duct (02) and not passing through the motor (041) or the area including the means (10) for heating the hot air flow (AC). Thus, the hair dryer (0) may produce a hot air flow (AC) and a cold air flow (AF), simultaneously. The hot air (AC) is produced and channeled in the second duct (02) and the cold air (AF), not heated, is channeled in the space formed between the first duct (01) and the second duct (02).

In certain embodiments, the second duct (02) includes at least one portion having the shape of a truncated cone of revolution. The end (023) of the second duct (02) opposite to the base (022) of the cone corresponds to the air outlet.

In certain embodiments, the length of the cone frustum is determined so that the end corresponding to the air outlet is protruding relatively to the end of the first duct (01).

Hair dryers are known which tend to distribute the fresh and hot air flows for different practical purposes like in the applications U.S. Pat. No. 7,412,789, EP 0970633 and U.S. Pat. No. 5,701,681. However these hair dryers do not give the possibility of distributing the air flows in an optimal way in order to allow proper drying of the hair with the hot air flow while guaranteeing sufficient cooling of the external duct.

In certain embodiments, in order to properly distribute the air, distribution means laid out at the base (022) of the cone determine the proportion between the air flow amount (AF) crossing the space between the first (01) and the second (02) duct on the one hand and that passing into the second duct (02) including the heating means (10) on the other hand. The configuration of the distribution means is determined so that the air flow amount (AF) crossing the space between the first (01) and the second (02) duct is comprised in a range from 5% to 20%, preferably 10%, of the air flow (042) brought by the device (04) producing an air flow (042). Thus, 80% to 95%, preferably 90%, of the air flow (042) brought by the device (04) producing an air flow (042) crosses the second duct (02).

In other embodiments, the distribution means are at least one ring-shaped passage in proximity to the base (022) of the cone, the center of each ring-shaped passage being comprised in the axis of the cone. The shape and the number of passages (07) are determined so that the amount of air flow (AF) crossing the space between the first (01) and the second (02) duct is comprised in a range from 5% to 20%, preferably 10%, of the air flow (042) brought by the device (04) producing an air flow (042). Thus, 80% to 95%, preferably 90% of the air flow (042) brought by the device (04) producing an air flow (042) crosses the second duct (02).

In other embodiments, the distribution means are formed by a space laid out between the base of the cone and the inner surface of the first duct (01), the diameter of the circle of the base (022) of the cone being, in these embodiments, less than the inner diameter of the first duct (01) in the area closest to the base of the cone. The diameter of the circle at the base of the cone and the inner diameter of the first duct are determined so that the amount of air flow (AF) crossing the space between the first (01) and the second (02) duct is comprised in a range from 5% to 20%, preferably 10%, of the air flow (042) brought by the device (04) producing an air flow (042). Thus, 80% to 95%, preferably 90%, of the air flow (042) brought by the device (04) producing an air flow (042) crosses the second duct (02).

In certain preferred embodiments, the distribution means are a plurality of longitudinal slots (07) distributed at the base (022) of the cone in order to determine the amount of air flow (AF) crossing the space between the first (01) and the second (02) ducts. The shape and the number of slots (07) determine the ratio of the amount of air between the heated air (AC) crossing the second duct and the non-heated air (AF) crossing the space between the first (01) and the second (02) duct. For example, the shape and the number of slots (07) are determined so that the amount of air flow (AF) crossing the space between the first (01) and the second (02) duct is comprised in a range from 5% to 20%, preferably 10%, of the air flow (042) brought by the device (04) producing an air flow (042). Thus, 80% to 95%, preferably 90%, of the air flow (042) brought by the device (04) producing an air flow (042) crosses the second duct (02). In this configuration, the longitudinal slots do not risk being blocked by hair or dust, for example like in at least one ring-shaped passage. Further, the distribution of the flow in the preferred range is easier to obtain.

In the embodiments where the distribution means are at least one ring-shaped passage in proximity to the base (022) of the cone or are a plurality of longitudinal slots (07), the diameter of the circle at the base (022) of the cone is adjusted to the inner diameter of the first duct (01).

In the embodiments where the distribution means are formed by the space laid out between the base of the cone and the inner surface of the first duct (01), the diameter of the circle at the base (022) of the cone is less than the inner diameter of the first duct (01).

Generally in a non-limiting way, spacers (09) join up the second duct (02) and the first duct (01) together by maintaining them at a distance from each other.

The device (04) producing an air flow (042), is preferably a centrifugal turbine positioned upstream from the motor (041) relatively to the direction of circulation of the air flow in the hair dryer (0). But the device (04) producing an air flow (042) may be an axial turbine or any other equivalent means. The centrifugal turbine is preferred since the centrifugal flow is easier to channel in both ducts, notably with the distribution means described hereinbefore.

Another advantage of the centrifugal turbine as compared for example with an axial turbine, is that it has better efficiency and allows high pressure to be obtained.

In certain embodiments, the centrifugal turbine includes in proximity to its axisymmetrical axis, an anti-hair baffle which prevents the hair from being sucked into the motor (041) and/or carried away by the turbine.

It is understood that a hair dryer is obtained with two ducts, the first of which channels a cold air flow between the first and the second duct while the air flow heated by a heating means is channeled inside with the second duct. The outer duct and the outer walls of the hair dryer are therefore cold.

Further, in the preferred embodiments, an optimal distribution of the air flows allows proper drying with the hot air flow while guaranteeing sufficient cooling of the duct with the cold air flow.

According to one configuration, the first duct (01) has the shape of a cylinder.

According to another configuration, the first duct (01) has the shape of a cone, the surface of which is substantially parallel to the surface of the second duct (02).

According to a configuration, the first duct (01) is preferentially coaxial with the second duct (02).

According to a configuration, the outer surface of the first duct (01) has a layout on its surface for improving the grasping by at least one hand of a user. Such a layout may apply various means such as those detailed hereafter for the extension.

According to a configuration, the hair dryer (0) is laid out for supporting at its rear portion (B) a silent, fixed device or which may be disassembled.

The invention further relates to a removable extension (1) for extending the air outlet of the hair dryer (0). The extension (1) notably gives the possibility of avoiding that a portion of the hand of the user is on the path of the outgoing air flow from the hair dryer (0), when, for example, the front portion of a compact hair dryer is not sufficiently long for the width of a hand or of four fingers of the user.

The extension may contribute to the grasping of the compact hair dryer with a bare hand by the front portion without any risk of burning oneself.

In certain embodiments, the extension may have at least the length of the width of a hand or of four fingers of the user. For these embodiments, the user may hold the hair dryer only with the extension or with a portion of his/her fingers on the extension and another portion of his/her fingers on the front portion of the hair dryer.

In other embodiments, the extension may have a length smaller than the width of a hand or of four fingers of the user. For these embodiments, the user may hold the hair dryer with a portion of his/her fingers on the extension and another portion of his/her fingers on the front portion of the hair dryer. The length of the extension is therefore not smaller than the width of two or three fingers so that the extension or the hair dryer/extension assembly may be grasped with the hand. The length of the extension is preferably less than or equal to the width of four or five fingers.

This extension (1) includes at least one peripheral tube (11) surrounding a central tube (12), the main axis of which are parallel. In a non-limiting way, spacers (13) join the peripheral tube (11) and the central tube (12) together. Each tube includes an inlet end (112, 122) and a free end (113, 123). At least the inlet end (122) of the central tube (12) is laid out according to a shape mating the end of the second duct (02) of the hair dryer (0) in order to be able to be attached to the second duct (02) of the hair dryer (0). The removability of the extension (1) gives the possibility of retaining the compactness of the hair dryer (0) without changing the center of gravity of the hair dryer (0) and/or by the fact that it does not extend too much and does not burden too much the front of the hair dryer and especially that it makes the hair dryer usable by grasping the front of the hair dryer with the bare hand.

It is thus understood that the extension may contribute to the grasping of the front portion of the hair dryer with a bare hand without burning oneself. The central tube channels the hot air flow and the peripheral tube channels the cold air flow between the central tube and the peripheral tube. The peripheral tube and the outer walls of the peripheral tube are therefore cold.

In certain embodiments, the peripheral tube (11) is coaxial with the central tube (12).

According to a configuration, the peripheral tube (11) of the extension is coaxial with the first duct (01) of the hair dryer (0) and the central tube (12) is coaxial with the second duct (02) of the hair dryer (0).

The hair dryer and the extension include mutual connection means.

According to a configuration, the connection means include fitting means. For example, the inlet end of the peripheral tube (11) is laid out according to a shape mating the end of the first duct (01) of the hair dryer (0) in order to be able to fit into the first duct (01) of the hair dryer (0).

According to a preferred configuration of the fitting means, the connection between the central tube (12) of the extension (1) and of the second duct (02) of the hair dryer (0) and/or the peripheral tube (11) and the first duct (01) of the hair dryer (0) is a conical connection. The ends facing the central tube (12) of the extension (1) and the second duct (02) of the hair dryer (0), protruding relatively to the end of the first duct (01), have mating supporting surfaces of conical shape.

According to a configuration, the connection means include attachment means, in order to attach the extension to the outlet of the hair dryer (0). In certain configurations, in order to maintain the connection conical, in a non-limiting way, the inlet end (112) of the peripheral tube (11) of the extension (1) includes at least one cutout so as to form at least one elastic tab. The free end of the tab(s) has a rib which may be inserted into a ring-shaped groove located on the inner surface of the first duct (01). When fitting the extension (1) on the hair dryer (0), the elastic tab(s) slightly deform(s) so that the rib does not interfere with the introduction of the peripheral tube (11) of the extension (1) into the first duct (01), since in this configuration, the outer diameter of the peripheral tube (11) is substantially equal to the inner diameter of the first duct (01). As soon as the rib of the tab(s) reaches the groove and is inserted therein, the tab(s) assume(s) their initial shape. In order for them to have the possibility of removing the extension (1) of the hair dryer (0), the tab(s) include(s) protrusions which allow disengagement of the ribs in the grove when pressure is applied thereon.

According to a configuration, the outlet of the hair dryer (0) is configured so as to optionally attach an endpiece, for example a concentrator or diffuser, in the place of the extension (1). This attachment may be configured in the same way as the extension (1): the inlet end (112) of the endpiece includes at least one cutout so as to form at least one elastic tab. The free end of the tab(s) has a rib which may be inserted into a ring-shaped groove located on the inner surface of the first duct (01) of the hair dryer.

In certain embodiments, the end (023) of the cone corresponding to the air outlet ends with a cylinder (021) of the same diameter as the diameter of the circle of the end (023) of the cone corresponding to the air outlet and is adapted for connecting the extension (1).

According to a configuration, the free end (113) of the peripheral tube (11) of the extension (1) extends beyond the free end (123) of the outlet of the central tube (12) in order to form for example an air concentrator (114) or an air diffuser.

According to another configuration, the free end (123) of the central tube of the extension (1) extends beyond the free end (113) of the outlet of the peripheral tube (11) in order to form an air concentrator or air diffuser.

According to certain embodiments, the extension may be oriented axially, i.e. by rotation around its longitudinal axis. Thus for example it is possible to orient the diffuser or concentrator axially. It is understood that this rotation may be completed with bare hands.

According to another configuration, a removable endpiece, such as a concentrator or diffuser may be adapted to the free end (113) of the outlet of the peripheral tube (11).

In certain embodiments, the extension (1) is replaceable with a concentrator or diffuser endpiece of the prior art.

In certain embodiments, the extension (1) may be interposed between the front portion of the hair dryer and the concentrator or diffuser endpiece.

According to another configuration, a removable endpiece such as a concentrator or a diffuser may be adapted to the free outlet end (113) of the central tube (12).

The concentrator and/or the diffuser may be handled by axial rotation with a bare hand even without any extension.

In certain embodiments, in order that the extension (1) may be easily grasped, the outer surface of the peripheral tube (11) of the extension (1) for example has an arrangement on its cylindrical surface for improving grasping at least by one hand of a user. As mentioned earlier, the length of the extension is in a preferred embodiment, preferably greater than or equal to two or three fingers and preferably for not too extending and burdening the hair dryer.

According to a configuration, the peripheral surface has the shape of a hand imprint or according to another configuration, pins or striations allowing adherence between the extension (1) and the hand(s). According to another configuration, the extension has an adhering material attached on its external surface.

According to another configuration, the external surface of the peripheral tube (11) has a particular shape adapted to the hands of the user.

According to another configuration, the external surface of the peripheral tube (11) has recesses having a shape adapted for a hand and/or fingers.

In certain embodiments, the second duct (02) of the hair dryer (0) and the central tube (12) of the extension (1) may be made in materials resistant to high temperatures, for example 200° C. As an example, they are made in polyamide 4-6 with 50% of glass fibers or polyamide 6-6 with 30% of glass fibers. The glass fibers may be replaced with glass beads.

In certain embodiments, this hair dryer (0) and/or the extension (1) may also allow the use of inexpensive materials or which do not require significant resistance to heat for making the first duct (01) of the hair dryer (0) or the peripheral tube (11) of the extension (1).

In certain embodiments, an extension (1) giving the possibility of obtaining a cold air layer parallel with a hot air layer, may be adapted to the outlet of the hair dryer (0). In these embodiments, the free end of the extension may have two parallel, for example rectangular, nozzles. The nozzle producing the cold air layer is in communication with a space comprised between the peripheral tube (11) and the central tube (12). The nozzle producing the hot air layer is in communication with the space comprised in the central tube (12).

The present description details various embodiments and configurations with reference to figures and/or technical characteristics. One skilled in the art will understand that the various technical characteristics of the diverse embodiments or configurations may be combined together unless the opposite is not explicitly mentioned or that these typical characteristics are incompatible. Also, a typical characteristic of an embodiment or of a configuration may be isolated from the other technical characteristics of this embodiment unless the opposite is mentioned, the structural adaptations being within the reach of one skilled in the art notably by means of the functional considerations described. In the present description, many specific details are provided as an illustration and by no means as a limitation, so as to specifically detail the invention, in particular both on a structural and functional level. One skilled in the art will however understand that the invention may be carried out in the absence of one or several of the specific details or with alternatives, notably by means of the described functional considerations. In other circumstances, certain aspects are not detailed so as to avoid obscuring and burdening the present description and one skilled in the art will understand that diverse and various means may be used and that the invention is not limited to the sole described examples.

It should be obvious that for those skilled in the art that the present invention allows embodiments in many other specific forms without departing from the field of application of the invention as claimed. Therefore, the present embodiments have to be considered as an illustration, but may be modified in the field defined by the scope of the appended claims, and the invention should not be limited to the details given above.

The invention claimed is:

1. A compact hair dryer, the hair dryer comprising:

at least one main body having a front portion and a rear portion and containing a motor driving a device producing an air flow sucked up through an air intake laid out in the rear portion, and a heater, wherein the front portion of the main body is configured to channel the air flow towards an air outlet laid out in the front portion, the front portion includes a first duct surrounding a second duct, the first and second ducts being arranged to be crossed by the air flow, the heater is configured to heat a portion of the air flow crossing the second duct, the air outlet is extendable with an extension including a central tube and at least one graspable peripheral tube surrounding the central tube, each tube including an inlet end and a free end, at least the inlet end of the central tube being laid out according to a shape mating an end of the second duct to be connectable to the second duct, the extension is configured for the air flow surrounding the central tube along an entire length of the extension, a shape of the second duct is a truncated cone of revolution, a distribution portion is arranged at a base of the cone upstream the second duct and configured to determine a proportion between an airflow amount crossing a space between the first and the second duct and that passing into the second duct including the heater, the distribution portion includes a plurality of longitudinal slots distributed at the base of the cone to determine a ratio of the airflow amount crossing the space between the first and the second duct, wherein the plurality of longitudinal slots extends from an edge of the base of the cone toward the end of the second duct, and the device is a centrifugal turbine configured to produce the air flow.

2. The hair dryer according to claim 1, wherein the extension is removable from the front portion of the at least one main body.

3. The hair dryer according to claim 1, wherein the distribution portion at the base of the cone is configured to determine a ratio of an amount of air flow between heated air crossing the second duct and non-heated air crossing the space between the first and the second duct so that the amount of air flow crossing the space between the first and the second duct is in a range from 5% to 20%.

4. The hair dryer according to claim 1, wherein the second duct of the hair dryer blowing hot air is surrounded by the first duct blowing cold air.

5. The hair dryer according to claim 4, wherein a connection between the central tube of the extension and the second duct of the hair dryer is a conical connection.

6. The hair dryer according to claim 4, wherein the inlet end of the peripheral tube is laid out according to a shape mating an end of the first duct of the hair dryer to fit into the first duct.

7. The hair dryer according to claim 4, wherein the peripheral tube is coaxial with the central tube.

8. The hair dryer according to claim 4, wherein the free end of the peripheral tube of the extension extends beyond the free end of the central tube to form at least one of an air concentrator or an air diffuser.

9. The hair dryer according to claim 4, wherein the extension is removable from the front portion of the at least one main body of the compact hair dryer.

10. The compact hair dryer according to claim 1, wherein the plurality of longitudinal slots extends in a longitudinal axis of the second duct.

11. A compact hair dryer comprising:

at least one main body having a front portion and a rear portion and containing a motor driving a device producing an air flow sucked up through an air intake laid out in the rear portion, and a heater, wherein the front portion of the main body is configured to channel the air flow towards an air outlet laid out in the front portion, the front portion includes a first duct surrounding a second duct, the air outlet is extendable with an extension including a central tube and at least one graspable peripheral tube surrounding the central tube, each tube including an inlet end and a free end, at least the inlet end of the central tube being laid out according to a shape mating an end of the second duct to be connectable to the second duct, the extension is configured for the air flow surrounding the central tube along an entire length of the extension, the device is configured to bring a portion of the air flow, to cross the second duct, said portion of the air flow being heated by the heater, another portion of the air flow, to cross a space between the first and the second ducts, said another portion of the air flow being isolated from the portion of the heated air flow in the second duct, the second duct includes at least one portion having a shape of a truncated cone of revolution, for channeling a portion of the air flow towards the center, and a distribution portion laid out at a base of the cone upstream the second duct and configured to determine a proportion between an amount of air flow crossing the space between the first and the second duct on the one hand and that passing into the second duct including the heater on the other hand, the distribution portion includes a plurality of longitudinal slots distributed at the base of the cone to determine a ratio of the airflow amount crossing the space between the first and the second duct, wherein the plurality of longitudinal slots extends from an edge of the base of the cone toward the end of the second duct, and the device is a centrifugal turbine configured to produce the air flow.

12. The compact hair dryer according to claim 11, wherein the distribution portion is configured to determine the proportion between the amount of air flow crossing the space between the first and the second duct on the one hand and that passing in the second conduit including the heater on the other hand so that the amount of air flow crossing the space between the first and the second duct is in a range from 5% to 20% of the air flow brought by the device.

13. The compact hair dryer according to claim 11, wherein the plurality of longitudinal slots is configured to determine the proportion between the amount of air flow crossing the space between the first and the second duct on the one hand and that passing in the second duct including the heater on the other hand so that the amount of air flow crossing the space between the first and the second duct is in a range from 5% to 20% of the air flow brought by the device.

14. The compact hair dryer according to claim 11, wherein a diameter of a circle at the base of the cone is adjusted to an inner diameter of the first duct.

15. The compact hair dryer according to claim 11, wherein the distribution portion is formed with the space laid out between the base of the cone and an inner surface of the first duct, a diameter of a circle at the base of the cone being less than an inner diameter of the first duct in an area closest to the base of the cone.

16. The compact hair dryer according to claim 11, wherein the plurality of longitudinal slots extends in a longitudinal axis of the second duct.

* * * * *